United States Patent [19]

Teske

[11] 4,186,854

[45] Feb. 5, 1980

[54] GATE FOR STORAGE-TANK OUTLET

[76] Inventor: Lothar Teske, Industriestr. 30, 5000 Cologne 90, Fed. Rep. of Germany

[21] Appl. No.: 872,832

[22] Filed: Jan. 27, 1978

[51] Int. Cl.[2] ..... B65D 47/00

[52] U.S. Cl. ..... 222/185; 222/512; 222/561

[58] Field of Search ..... 222/185, 460–462, 222/505, 512, 559, 561; 251/144, 175, 176

[56] References Cited

U.S. PATENT DOCUMENTS

| | | | |
|---|---|---|---|
| 760,772 | 5/1904 | Anderson et al. | 222/561 X |
| 2,989,008 | 6/1961 | Lindstrom | 222/512 X |
| 3,106,899 | 10/1963 | Dorey | 222/559 X |
| 3,480,186 | 11/1969 | Grosko | 222/512 |
| 3,576,198 | 4/1971 | Bessot | 251/175 X |
| 4,063,668 | 12/1977 | Shapland et al. | 222/512 |

*Primary Examiner*—Robert J. Spar
*Assistant Examiner*—Fred A. Silverberg
*Attorney, Agent, or Firm*—Karl F. Ross

[57] ABSTRACT

A gating mechanism for selectively opening and closing the bottom outlet of a container such as a tank, bunker or silo, serving for the storage of bulk material, comprises a metallic slider shiftable along the underside of a metallic sealing frame surrounding the outlet, the slider being urged upwardly against that frame by strong compression springs or fluidic jacks counteracting the internal pressure of the goods. The slider, which has a cutout registering with the outlet aperture upon being aligned with the sealing frame, is displaceable between this alignment position and a closure position by a rack on its underside engaged by a driving pinion. A base supporting the slider and forming a channel for the discharged bulk material carries a funnel of rectangular cross-section which defines the outlet and has a flange vertically separated from a discharge port in the container bottom by an interposed spacer frame which can be replaced by a shutter plate of like thickness, e.g. during temporary removal of the slider, upon a raising of the empty tank and a lifting of the spacer frame to a lesser extent with the aid of respective nuts on a set of vertical bolts passing through bores in an external apron of the container body and through slotted lugs of the spacer frame.

8 Claims, 5 Drawing Figures

GATE FOR STORAGE-TANK OUTLET

My present invention relates to a gating mechanism for the selective blocking and unblocking of an outlet of a container, such as a tank, bunker or silo, forming part of a facility for the storage of bulk material (e.g. grain or coal).

BACKGROUND OF THE INVENTION

Conventionally, such outlets—usually provided at the bottom of the container—are closable by a slider having a cutout which conforms to the outlet opening and is alignable therewith in an unloading position, the outlet being obstructed by a solid portion of the slider upon displacement thereof to a closure position. The slider is sandwiched between upper and lower gaskets respectively carried on the rim of the outlet and on a downward extension thereof, these gaskets being intended to insure an airtight seal when the outlet is closed. In the closure position, the weight of the stored goods bears upon the slider with resulting compression of the lower gasket; this may lead to a separation of the slider from the upper gasket, with particles of the bulk material penetrating into the resulting gaps. The subsequent shifting of the slider causes these particles to rub against the upper gasket which is therefore subjected to considerable wear. Thus, the desired airtight seal will no longer be maintainable.

OBJECTS OF THE INVENTION

The general object of my present invention, accordingly, is to provide an improved gating mechanism for the selective blocking and unblocking of such container outlets with avoidance of the aforestated drawbacks.

A related object is to provide means for temporarily shutting off such an outlet ahead of the sliding gate when the latter is inoperative for any reason.

SUMMARY OF THE INVENTION

A gating mechanism according to my invention comprises a preferably metallic slider which, in contradistinction to the conventional arrangement referred to above, is in direct fluidtight surface contact with a sealing frame rimming the container outlet, that frame being preferably also made of metal. The fluidtight contact is maintained by pressure means, such as strong coil springs or fluidic jacks, bearing upon the slider from the side opposite the outlet; it will be convenient to refer to that side of the slider as its undersurface. The slider is guided by fixed support means, independent of the aforementioned pressure means, on a structure (referred to hereinafter as a base) which forms a channel for the bulk material discharged from the container outlet; the base is provided with drive means for alternately displacing the slider into its unloading and closure positions.

As long as the force of the pressure means is sufficient to overcome the opposing forces acting from within the container upon the slider, especially the weight of the stored goods in the case primarily here considered, no gaps will develop between the upper slider surface and the rim surface in contact therewith; evidently, these contact surfaces are to be carefully machined and finely honed or otherwise smoothed, possibly with the aid of a low-friction coating.

On account of unavoidable manufacturing tolerances, the drive means for the shifting of the slider should be coupled therewith only loosely so as not to interfere with the action of the pressure means holding the slider firmly against the outlet rim, I have found that, for this purpose, it is advantageous to use a rack-and-pinion drive. The rack, fixedly secured to the underside of the slider, is engaged by the manually or automatically driven pinion with a certain amount of play and, preferably, at a location offset from the container outlet in the longitudinal direction, i.e. the direction of displacement.

If the contact surfaces of the slider and the sealing frame shown signs of wear, they may be readily reground or recoated since they will both be accessible upon separation of the slider from the previously emptied container. In the event of prolonged removal of the slider, or if the gating mechanism is otherwise inoperative, it may be desirable to provide alternate means for temporarily sealing the container outlet until normal operation is resumed. For this purpose, pursuant to a further feature of my invention, the outlet may be formed on a preferably funnel-shaped downward extension of the container body, with interposition of a spacer frame between a discharge port of that body and its extension. Upon a slight lifting of the container body with reference to the base carrying the extension, the spacer frame can be extracted and replaced by a solid shutter plate of similar thickness which seals the discharge port above the outlet proper.

BRIEF DESCRIPTION OF THE DRAWING

The above and other features of my invention will now be described in detail with reference to the accompanying drawing in which.

SPECIFIC DESCRIPTION

Figure 1:
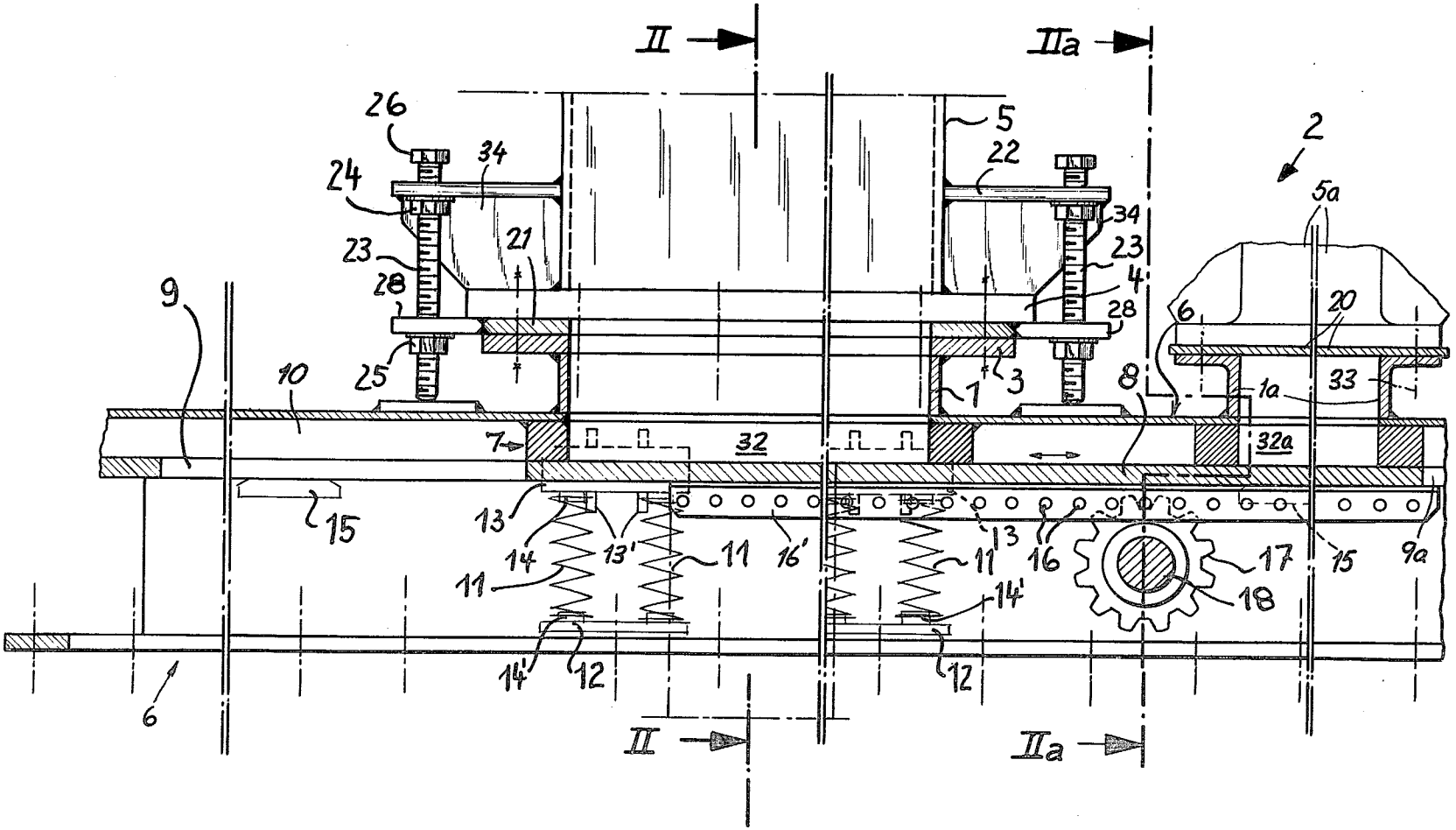
FIG. 1 is a longitudinal sectional view of a gating mechanism according to my invention serving a plurality of storage tanks shown only in part, the mechanism including a set of coil springs serving as pressure means.
Figures 2, 2A:
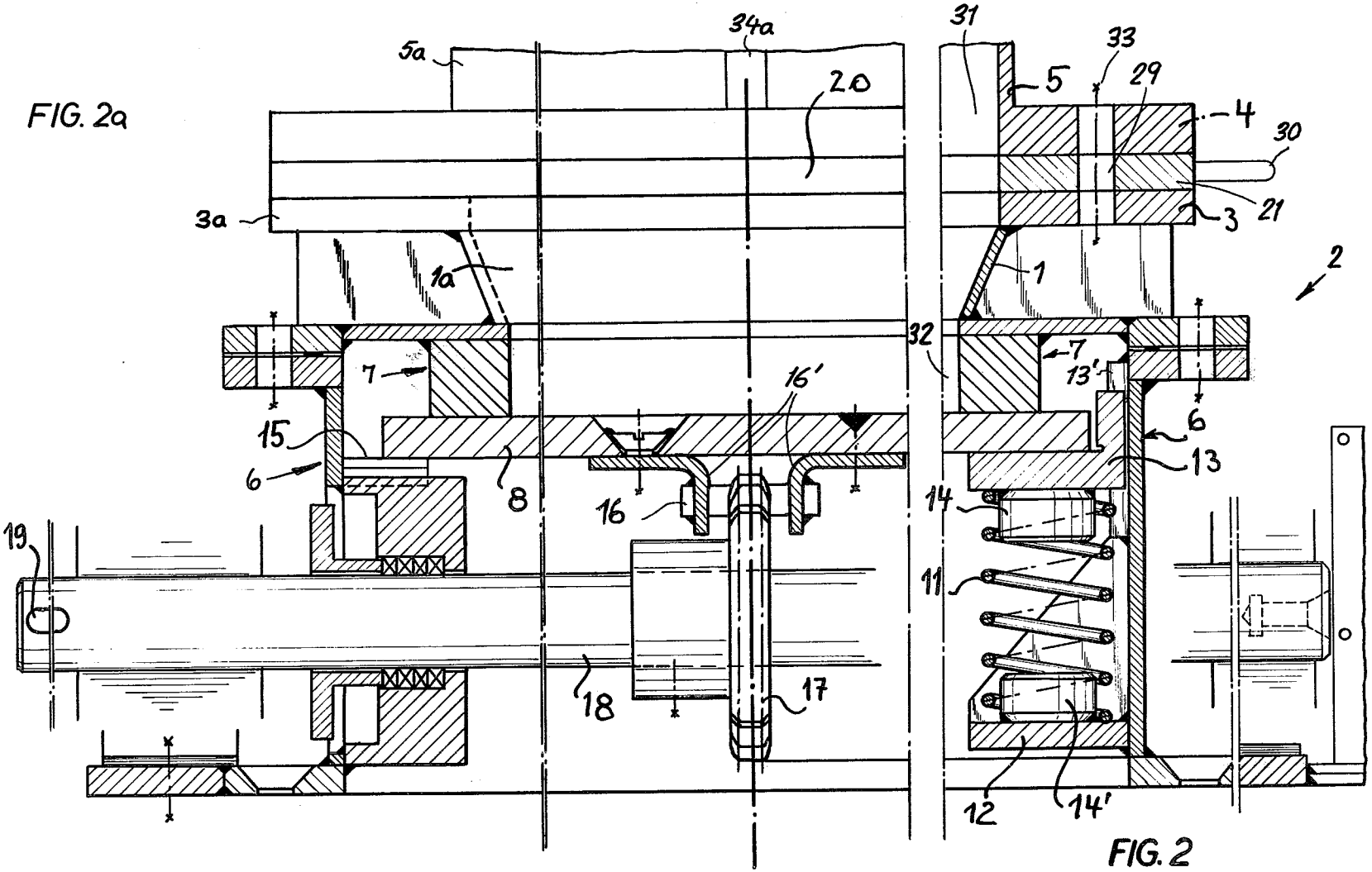
FIG. 2 is a fragmentary cross-sectional view taken on the line II—II of FIG. 1 and drawn to a larger scale.
FIG. 2*a* is a similar cross-sectional view, complementary to that of FIG. 2, taken on the line II*a*—II*a* of FIG. 1.

In FIGS. 1, 2 and 2*a* I have shown a base 6 forming a channel for bulk material to be unloaded from a group of storage tanks rising above the base along that channel, two such tanks having been partly shown at 5 and 5*a*. The nonillustrated lower part of the base may be provided with a lateral slot through which the bulk material discharged into the channel from any such tank may be extracted with the aid of an impeller wheel traveling along the slot, as disclosed in my copending application Ser. No. 855,270 filed Nov. 28, 1977.

Tank 5, which is representative of the others, has a bottom flange 4 surrounding a discharge port 31 (see FIG. 2) in line with an outlet 32 which is rimmed by a rectangular sealing frame 7. This frame, rigid with base 6, lies at the bottom of a funnel-shaped neck 1 (also of rectangular cross-section) forming a downward extension of port 31. Neck 1 has a top flange 3 which is approximately coextensive with flange 4 and is vertically separated therefrom by a spacer frame 21 more fully described hereinafter with reference to FIG. 3. A corresponding neck 1*a* of tank 5*a* is shown to have a flange 3a. Neck 1 and frame 7 are secured to base 6 by welding, as shown.

The highly polished undersurface of metallic sealing frame 7 is in firm contact with a similarly polished upper surface of an elongate metallic slider 8 which is pressed upwardly against frame 7 by a set of strong coil springs 11 arrayed in two rows along the opposite longitudinal edges of the slider, at locations laterally offset from outlet 32 as seen in FIG. 2. Slider 8 has a rectangular cutout 9 which, in an unloading position, registers with the identically dimensioned outlet 32. The slider is guided by longitudinal bars 10 of base 6, in line with the lateral members of frame 7, and rests on skids 15 secured to the sidewalls of the base.

The springs 11 are grouped in pairs each acting, as best seen in FIG. 2, upon the slider 8 through a vertically movable bracket 13 guided by fixed ribs 13', the bracket reaching around the corresponding longitudinal edge of the slider and carrying two bosses 14 serving to center the associated spring pair. Similar bosses 14' on shelves 12, rigid with base 6, extend from below into the springs 11 resting on these shelves.

Although only two pairs of springs 11 in the immediate vicinity of outlet 32 have been illustrated, it will be understood that these pressure elements may be duplicated elsewhere and especially in the region of outlet 32a of tank 5a.

A rack fixedly secured to the underside of slider 8 comprises a pair of stringers 16' spanned by a set of pins 16 which are engageable by the teeth of a driving pinion 17 keyed to a transverse shaft 18. The latter, as shown in FIG. 2a, has a projecting extremity formed with a keyway 19 to which a nonillustrated crank or driving gear may be attached. Clockwise rotation of shaft 18 as viewed in FIG. 1 aligns the cutout 9 with outlet 32; couterclockwise rotation aligns a similar cutout 9a with outlet 32a while holding the outlet 32 closed. If desired, slider 8 may be formed with further cutouts alignable with the outlets of other tanks not shown; naturally, it is also possible to provide each tank with its own slider.

Figure 4:
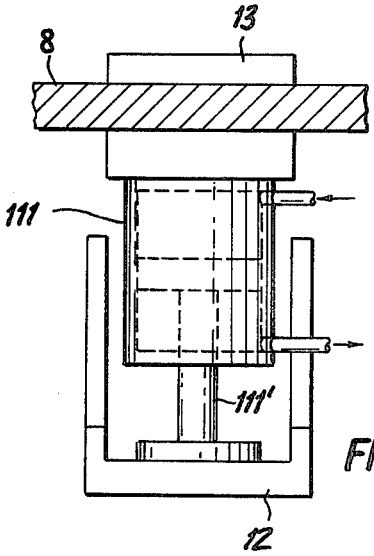
FIG. 4 is an elevational view of a lifting jack forming part of a set of such jacks usable in lieu of the coil springs of FIGS. 1 and 2.

The several coil springs 11 may be replaced by different pressure elements in the form of fluidic jacks 111, shown in FIG. 4, with pistons 111' loaded by compressed air, for example, A release of the pressure in the cylinders of these jacks facilitates the disassembly of the gating mechanism, with removal of slider 8 for inspection or repair.

Figure 3:
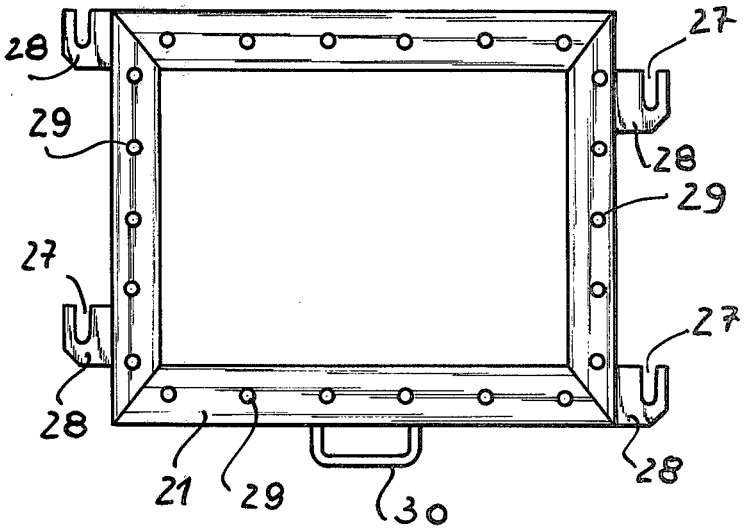
FIG. 3 is a top view of a spacer frame.

In the event of such removal, the port 31 of tank 5 may be sealed by a shutter plate 20 replacing the spacer frame 21 as particularly illustrated for tank 5a. To this end it is merely necessary to elevate the tank 5 to a certain extent, thereby increasing the separation of flanges 3 and 4, and then to lift the frame 21 to a lesser extent so as to let it lie clear of both flanges, allowing its lateral extraction with the aid of a handle 30. As best seen in FIG. 3, frame 21 is provided along its minor sides with two pairs of external lugs 28 forming slots 27 which in its working position are penetrated by respective bolts 23 also passing freely through bores in an apron 22 welded to the outer surface of tank 5, this apron being supported by webs 34 (tank 5a has similar webs 34a). Bolts 23 have hexagonal heads 26 engageable by a wrench in order to hold these bolts stationary upon rotation of respective nuts 24 which lie beneeth apron 22 and serve to raise and lower the tank 5 with reference to the base 6; other nuts 25 on bolts 23 underlie the lugs 28 and can be rotated to raise the frame 21 or the plate 20 of the flange 3 preparatorily to extraction. Upon reinsertion of either the shutter plate or the spacer frame, the nuts 25 are reverse-rotated to let the insert come to rest on flange 3 whereupon nuts 24 may also be so rotated to lower the flange 4 onto this insert.

Spacer frame 21 has a number of holes 29 serving for the insertion of fastening screws 33, indicated schematically, to immobilize the assembly. Similar holes are provided in shutter plate 20 which also has a handle corresponding to handle 30 of frame 21.

I claim:

1. In a storage facility for bulk material, including a container body with a discharge port surrounded by a bottom flange above a base forming a channel for bulk material discharged from said port, the combination therewith of:

a funnel supported on said base and provided with a top flange underlying said bottom flange in substantial alignment therewith, said funnel forming an outlet for said bulk material;

a sealing frame underneath said funnel rimming said outlet;

a slider having a solid portion in direct fluidtight contact with the underside of said sealing frame in a closure position, said solid portion being withdrawable from said outlet in an unloading position;

pressure means bearing upon said slider from below for maintaining said fluidtight contact;

fixed support means on said base for guiding said slider between said closure position and said unloading position;

drive means on said base for displacing said slider into either of said positions;

a spacer frame interposed between said top and bottom flanges; and lifting means on said body for increasing the separation of said flanges to facilitate extraction of said spacer frame and replacement thereof by a substantially coextensive shutter plate.

2. The combination defined in claim 1 wherein said drive means comprises a rack rigid with said slider and a pinion in mesh with said rack, said pinion being offset from said outlet in the direction of displacement.

3. The combination defined in claim 1 wherein said pressure means comprises a set of pressure elements offset from said outlet and arrayed along opposite longitudinal edges of said slider extending in the direction of displacement.

4. The combination defined in claim 3 wherein said pressure elements are coil springs.

5. The combination defined in claim 3 wherein said pressure elements are fluidic jacks.

6. The combination defined in claim 3 wherein said pressure means further comprises a plurality of brackets interposed between said pressure elements and a surface of said slider opposite said outlet, said brackets reaching around said longitudinal edges while being guided along said structure in a direction perpendicular to said surface.

7. The combination defined in claim 1 wherein said slider frame and said sealing frame are metallic and have smooth contact surfaces.

8. The combination defined in claim 1 wherein said lifting means comprises a set of bolts traversing an external apron of said body and bearing upon said base, said spacer frame and said shutter plate being provided with slotted peripheral lugs engageable with said bolts, each of said bolts being provided with a first nut underlying said apron and with a second nut underlying one of said lugs for an independent raising of said body and of said spacer frame or said shutter plate.

* * * * *